United States Patent [19]

Nguti

[11] Patent Number: 4,940,286

[45] Date of Patent: Jul. 10, 1990

[54] BED ATTACHMENT AND PIECE OF FURNITURE DEVICE

[76] Inventor: Tallam I. Nguti, 619 Elmwood Ter., Rochester, N.Y.

[21] Appl. No.: 259,263

[22] Filed: Oct. 18, 1988

[51] Int. Cl.[5] ..... A47C 7/50

[52] U.S. Cl. ..... 297/429; 5/443; 5/508; 128/845; 297/423

[58] Field of Search ..... 5/431, 443, 60, 508; 128/845; 269/328; 297/423, 429

[56] References Cited

U.S. PATENT DOCUMENTS

| | | | |
|---|---|---|---|
| 130,903 | 8/1872 | Defoe | 297/429 |
| 677,672 | 7/1901 | Libby | 5/508 |
| 1,215,850 | 2/1917 | Potts | 5/508 |
| 1,279,120 | 9/1918 | Kellogg | 297/429 |
| 3,318,596 | 5/1967 | Herzog | 5/68 |
| 3,813,091 | 5/1974 | Metzger | 269/328 |
| 4,225,127 | 9/1980 | Strutton | 269/328 |
| 4,373,222 | 2/1983 | Wolfe et al. | 5/431 |

*Primary Examiner*—Alexander Grosz

[57] ABSTRACT

A bed attachment and piece of furniture device is suitable for use generally and copulatively by an arm amputee or other handicapped individual who has lost effective use of one or both arms. The device includes a seat member that has a narrow depth ischium support section adjoining a legs support section that is split into left leg and right leg support portions. The device further includes an access spacing between the leg support portions, and means for supporting the seat member at a predetermined copulative height.

15 Claims, 2 Drawing Sheets

BED ATTACHMENT AND PIECE OF FURNITURE DEVICE

BACKGROUND OF THE INVENTION

This invention relates to devices for use by handicapped individuals, and more particularly to a bed attachment and piece of furniture device for use by an arm amputee or other handicapped individual who has lost effective use of one or both arms.

More and more, society is recognizing that special accommodations and special devices have to be provided for helping the handicapped in most places and areas of human activity. The bedroom, as such a place and area, is no exception. In the bedroom of any home or place of abode, a bed is usually the biggest and the most important piece of furniture. A bench, a slipper chair or a chaise lounge, for sitting on while dressing or relaxing, are among the other common types of pieces of furniture found in the bedroom.

Webster's Third New International Dictionary defines a bed as a piece of furniture on which one may lie down or sleep, and as a place of marital sex relations. For the majority of people, these definitions are accurate and true in life. However, for an arm amputee or other handicapped individual who has lost effective use of one or both arms, the second definition is not accurate and not true in life. In fact, it is mostly and practically impossible. This is because one's use of a bed or bed-type piece of furniture as a place of marital sex relations, due to the nature of human anatomy, usually requires the full and effective use of one's arms for supporting one's body-weight to the side or from a prone or semi-prone position. Consequently, any arm amputee or other handicapped individual, who has lost effective use of one or both arms, is particularly and even more seriously handicapped in this area of human conduct. There is therefore a need to provide devices for helping such arm amputees and other handicapped individuals in this area.

SUMMARY OF THE INVENTION

It is an object of the present invention to provide a tasteful and ordinary looking body-weight supporting seat-type bed attachment device for use generally and copulatively by an arm amputee or other handicapped individual who has lost effective use of one or both arms.

It is another object of the present invention to provide a tasteful and ordinary looking body-weight supporting seat-type piece of furniture device that can stand alone and be suitable for sitting and relaxing on, as well as, for use copulatively by an arm amputee or other handicapped individual who has lost effective use of one or both arms.

In accordance with the present invention, a tasteful and ordinary looking body-weight supporting seat-type bed attachment and piece of furniture device includes a seat member and a main supporting means supporting the seat member at first and second predetermined copulative heights for an arm amputee or other handicapped individual who has lost effective use of one or both arms. The seat member includes an ischium support section and a separate legs support section. The legs support section further includes separate left leg and right leg support portions that define an access spacing adjacent the ischium support section.

BRIEF DESCRIPTION OF THE DRAWINGS

In the detailed description of the preferred embodiments of the present invention presented below, reference is made to the accompanying drawings, in which.

DETAILED DESCRIPTION OF THE PREFERRED EMBODIMENTS

Figure 1:
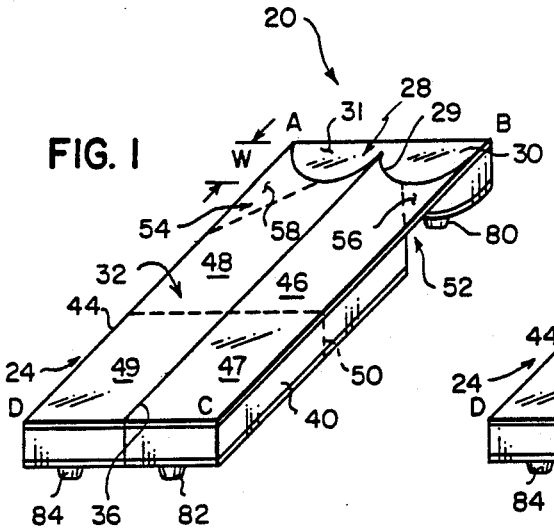
FIG. 1 is a perspective illustration of the seat-type bed attachment device of the present invention.

Referring now to FIGS. 1 through 4, the bed attachment and piece of furniture device of the present invention is generally designated 20. Device 20 is a tastefully designed upholstered or cushioned body-weight supporting seat-type bed attachment and piece of furniture that includes a seat member 24, shown, for example, as a full length rectangular member ABCD, having a back end AB and a front end CD. Seat member 24, however, may take on various designer type shapes, provided it includes a plane surface suitable for sitting, relaxing or sleeping on. Although one can generally sit on the member 24 with one's legs over to the side AD or BC, the preferable and effective manner of sitting thereon for the objectives of the present invention is for one to sit with one's back towards, and at, the back end AB, and with one's legs stretched out towards the front end CD.

Basically, seat member 24 includes an ischium support section 28 located crosswise at the very back end AB, and a separate legs support section 32. Ischium support section 28 desirably has a narrow, less than conventional back-to-front sitting depth W, a crosswise seat-width substantially equal to the width AB of seat member 24, a front edge ARB, and a back edge coincident with the back edge of the back end AB. Ischium support section 28 may simply have a generally rectangular shape having the seat-width AB, and the seat-depth W, or it may take on various shapes with substantially the dimensions AB and W. For the majority of user, the narrow sitting depth W is within the range of 13 to 25 centimeters (about 5 to 10 inches). Ischium support section 28 may be shaped, for example, like a semicircular segment having a chord AB, or as illustrated, it preferably may have a generally curvilineal front edge that includes a reverse radius front-to-back cutout 29 as traced by the front edge ARB. Preferably therefore, ischium support section 28 comprises two subsections 30, 31 that make it resemble the capital letter B, or the front view of the top-half of a human heart. In fact, the subsections 30, 31, provided they retain the indicated proximity, could actually be separate, forming as it were two semicircular segments or other shapes for sitting on.

As its name implies, the primary function of ischium support section 28 is to accommodate and support the ischium of a person sitting in the preferred manner on the seat member 24. The subsections 30, 31, of the ischium support section 28 accommodate the surface muscles that cover the ischium, namely, the gluteus maximus, but only as much of such muscles as are pressed against the subsections by the ischium. Depending on the exact sitting posture of the user, the section 28 may alternatively accommodate and support the coccyx and a part of the sacrum, and hence!their surface muscles. Again, the purpose of the narrow sitting depth W of the ischium support section 28 is to ensure that no part of the gluteus maximus forwards of the ischium region, and hence no part of the thigh of the user, are accommodated or supported by the section 28. It is instead the function of the legs support section 32 of seat member 24 to support these latter regions of the user's body.

Legs support section 32 is separate from, but adjoins the ischium support section 28 from which it extends all the way to the front end CD of seat member 24 The section 32 is split, lengthwise (back-to-front) along a line 36, into a left leg support portion 40 and a right leg support portion 44. A user sitting in the preferred manner on seat member 24 will ordinarily have the left leg over the portion 40 and the right leg over the portion 44. Portions 40 and 44 each further consist respectively of an upper leg support subportion 46, 48, and a lower leg support subportion 47, 49. The division between the upper and lower support subportions is defined by a knee-type joint 50 about which each portion 40, 44 can articulate, much like a person's knee. The location of joint 50 should preferably be adapted to coincide with the position of the knee of an intended user.

Figure 3:
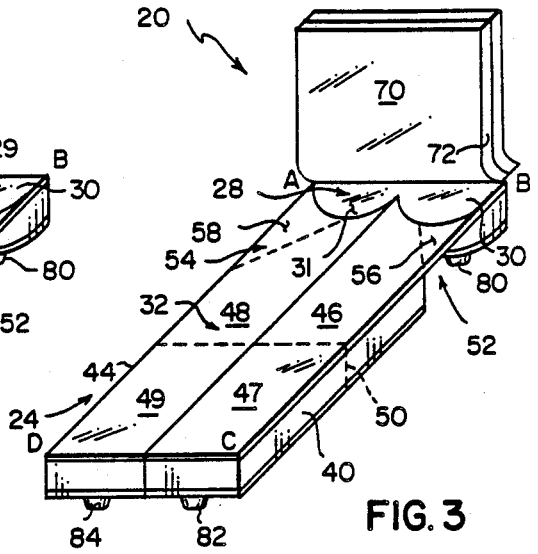
FIG. 3 is a perspective illustration of a piece of furniture device that includes the bed attachment of FIG. 1 and a back and head support member.
Figure 2:
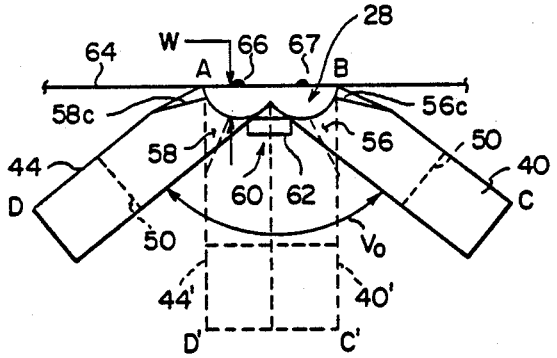
FIG. 2 is a top view schematic of the bed attachment device showing the left leg and right leg support portions in an open or apart position.
Figure 4:
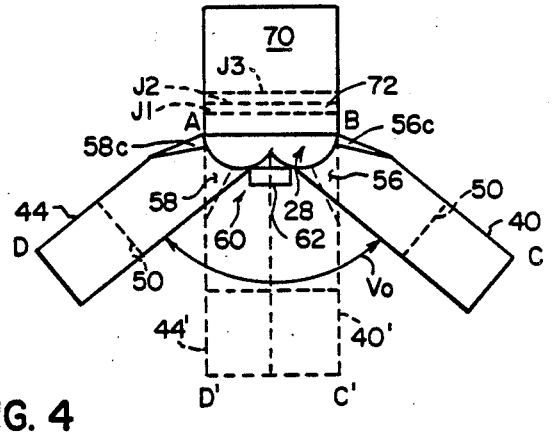
FIG. 4 is a top view schematic of the piece of furniture device of FIG. 3.

Leg support portions 40, 44, in addition, are each pivotable outwards from a closed position as shown, for example, in FIGS. 1 and 3, to a wide open or apart position, as shown in FIGS. 2 and 4. In the closed position, the portions should preferably come in contact with each other, and may thus be latched together. The pivot point for such inwards and outwards movement is preferably under, at, or close to, the ischium support section 28. To facilitate such pivotal motion, each portion 40, 44 further includes a cutout 52, 54, respectively. Cutouts 52, 54 which may each be wedge-shaped, are located on the outside edges BC and AD, where the portions 40, 44 adjoin the ischium support section 28. The angle of the cutouts 52, 54 into each portion 40, 44, should be such as will minimize the size of the cutout and yet allow the portions 40, 44 to pivot outwards as far as possible without any part thereof moving any further backwards of the back end AB of the ischium support section 28. The seat surface areas over the cutouts 52, 54, are designated 56, 58 respectively when portions 40, 44 are in the closed position. Seat surface areas 56, 58 may be strung with collapsible material, such as an upholstry fabric, that collapses into the shapes **56*c*, 58*c* when the portions 40, 44** are in the open or apart position.

When in such wide open or apart position, the portions 40, 44 define an access angle V between them, as well as, create an access spacing 60 adjacent the front edge ARB of the ischium support section 28. The spacing 60 is preferably at least as wide as the hip-width of a user standing or kneeling adjacent to, and facing, the front edge ARB of the ischium support section 28. For the majority of persons in the user population, the spacing 60 will be of such width when the access angle V is at least 90 degrees or more.

It is not necessary, however, that the spacing 60 be created by pivotal motion of the portions 40, 44. To create the spacing 60, portions 40, 44 may in the alternative merely move or slide laterally away from the closed position to the open or apart position and then back to the closed position. Other ways of moving the portions 40, 44, away from each other and from the ischium support section 28 in order to create an access spacing 60, will also be effective.

As shown in FIGS. 2 and 4, for example, the device 20 may also include a unit 62, such as a cushion or a bench for kneeling or standing on. It is preferably for kneeling on, and is located within the spacing 60 below the top of the ischium support section 28, and directly in front of the front edge ARB. The unit 62 is concealabe by the leg support portions 40, 44 when in their closed position (shown for contrast in FIGS. 2 and 4 using reference numerals 40', 44', etc.), and may be selectively pushed or otherwise moved out of the way. As also shown in FIGS. 1 and 2, the device 20 in a first embodiment, is particularly useful as a bed attachment device, and so may be attached firmly to the end or side rail 64 of a bed (not shown) using attaching means 66, 67. When so attached, the back end AB is adjacent the bed and the upholstered or cushioned top of the seat member 24 is preferably lower than or equal in height to the top of the mattress or sleeping surface of the bed.

On the other hand, FIGS. 3 and 4 illustrate a second embodiment of the device 20 of the present invention. This second embodiment includes a back and head support member 70, and is particularly useful as a stand-alone piece of furniture device, such as an armless chaise lounge or other suitable body-weight supporting seat-type piece of furniture. Although member 70 is shown as an ordinary rectangular shape, it can take on various designer and more appealing shapes as are common with ordinary looking pieces of furniture. Back and head support member 70 is connected to the back end AB of ischium section 28, and may include a lumbar support means 72 that is creatable, for example, by articulation of the member 70 along, and about, joints J1, J2, J3 (FIG. 4)

Additionally, both the first and second embodiments of the device 20 of the present invention include supporting means 80 for supporting the seat member 24. The means 80, for example, may include any suitable supporting member such as a pedestal or a frame with a base or legs. It is of course well known to make seat member supporting means, such as the means 80, height adjustable, and capable of various types of articulating movements about predesigned joints. Given suitable members, such adjustability and other movements, of various sections, portions, and subportions of the supported seat member, can be achieved manually (including use of the feet) or automatically. For such automatic adjustment and movement, however, additional means, such as a power source and pneumatic or hydraulic cylinders and the like, should be included at such joints. The objective and scope of each adjustment and movement is of course to conform the various sections, portions and subportions of the seat member, for example, the seat member 24 of the device 20, to the various and comfortable ways and positions in which a user of the device desirably may want to sit thereon.

Figure 5:
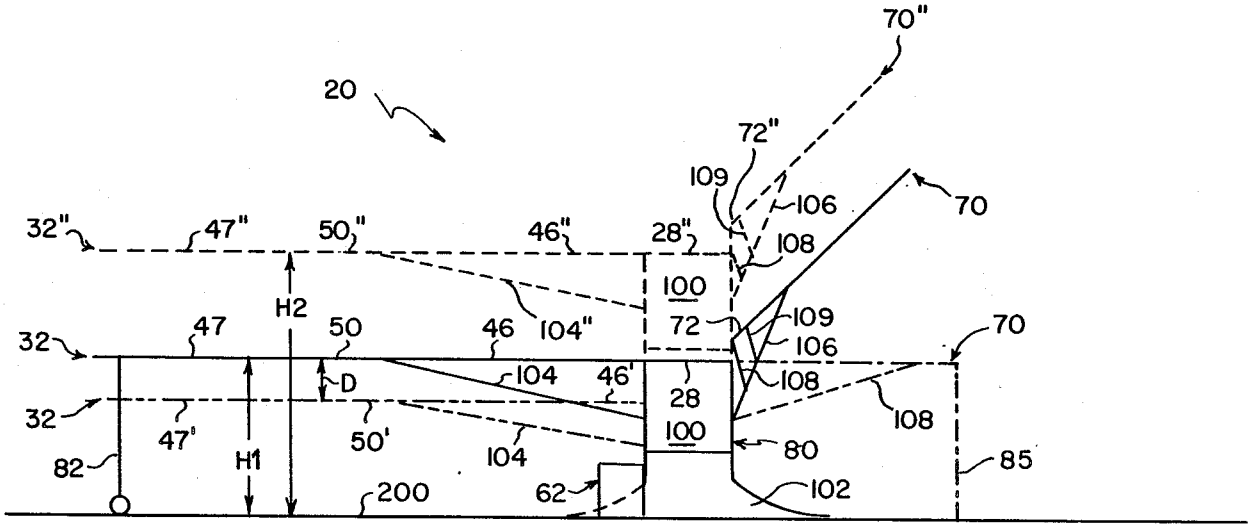
FIG. 5 is a side elevational schematic showing the means for supporting, adjusting and otherwise moving the various sections and portions of the seat and back support members of the device of the present invention.

Referring now to FIG. 5, means 80 for supporting, adjusting, and otherwise moving the back and head support member 70, as well as, the seat member 24 including its various sections, portions and subportions, are shown. Such supporting means 80 includes (a) the seat member main supporting means 100, (b) optional front end legs 82, 84 for supporting the left leg and right leg support portions 40, 44, (c) optional rear end leg 85 for supporting the back and head support member 70, and (c) members 104, 106(not shown), 108, 111, 112 and joints 50, J1, J2 and J3, as illustrated.

Optional front end legs 82, 84 may be on casters in order to facilitate the inward and outward movement of the portions 40, 44. The main supporting means 100 is located directly underneath, and principally supports, the ischium support section 28. Members 104, 106 and 108 are connected to the means 100, and in addition, are respectively connected to, and support the left leg supporting portion 40, the right leg supporting portion 44, and the back and head support member 70. The member 70 may be pivotably movable up and down on, and relative to the main supporting means 100. The joint 50 on the portions 40, 44, divides each into upper and lower leg support subportions 46, 47, 48, 49, as well as, enables knee-type articulation of each thereabout. The members 111, 112 which may be connected to the member 108 and to the joints J1, J2 or J3 on the member 70, cooperate to create the lumbar supporting means 72, by enabling articulation of member 70 about the joints J1, J2 or J3.

As shown in FIG. 5, the supporting means 80 further includes the main supporting means 100, such as a pedestal, that has a broad base 102 for principally stabilizing and balancing the body-weight of a person properly using the device 20. The main supporting means 100 is preferably height adjustable by employing any of various well known methods and devices. In configured cooperation with the members 104, 106 and 108, main supporting means 100 intendedly is capable of supporting the body-weight of the user at first and second predetermined copulative heights H1 and H2. At H2, the positions of the various members, sections, portions and subportions of the device 20 are shown (FIG. 5) using the reference numerals 28', 32', 46', etc.

The predetermined copulative height H1 is equal to the distance between the top of the ischium support section 28, and a reference surface 200, such as the floor on which the device 20 itself sits, when the top of the ischium support section substantially is at the same level as the crotch region of an arm amputee or other handicapped individual user kneeling on the reference surface 200 adjacent to, and facing, the ischium support section 28. For the majority of users, the height H1 is within the range of *33* to *43* centimeters (about *13* to *17* inches) On the other hand, the predetermined copulative height H2 is equal to the distance between the top of the ischium support section 28, and a reference surface 200, such as the floor on which the device 20 itself sits, when the top of the ischium support section is substantially at the same level as the crotch region of the arm amputee or other handicapped individual user standing on the reference surface 200 adjacent to, and facing, the ischium support section 28. For the majority of users, the height H2 is within the range of *76* to *92* centimeters (about *30* to *36* inches).

Consequently, when the arm amputee or other handicapped individual user kneels or stands on a reference surface (such as the top of the unit 62) which is different from the surface such as the floor on which the device 20 sits, the heights H1 and H2 shall be measured from the top of the ischium support section down to the surface on which such arm amputee or other handicapped individual is kneeling or standing. It should be noted that the heights H1, H2 are shown in FIG. 5, as they are, simply because, as illustrated, the arm amputee or other handicapped individual is contemplated as kneeling or standing on the reference surface 200, and because the heights of the legs support section 32, above such reference surface, are the same as those of the ischium support section 28.

As further illustrated in FIG. 5, the legs support section 32 and the back and head support member 70 can be supported at the heights H1 and H2 right along with ischium support section 28 by means of the members 100, 104, 106, and 108. Note that although the member 70 is principally shown in one of its raised positions at H1 and H2, it can also be lowered- to a substantially horizontal orientation at H1 and H2 as shown, for example, in phantom at H1 using the reference numerals 70'', 108'', etc. As shown in FIG. 5, the member 104, which is connected to the main support means 100, supports the left leg support portion 40, and hence can move in and out, for example, pivot in and out, with the portion 40 between its apart and its closed positions. Member 104 can also slide with respect to portion 40 while pivoting up and down with respect to the main support means 100 in order to pivotally raise the front end of member 40 with respect to the top of the ischium support section 28. Furthermore, portion 40, which can articulate, much like a knee, about the joint 50, can also be lowered by suitable means (not shown) a variable distance D below the top of the ischium support section 28.

The member 106 which supports the right leg support portion 44 (FIGS. 1 to 4) operates with respect to the portion 44, exactly the same way the member 104 operates with respect to the portion 40, as described above. In fact, although members 104 and 106 can so operate independently, it is preferable that they operate in unison. Portion 44, of course, also includes means for variably lowering it a distance D, with respect to top of the ischium support section 28. The position of the portions 40, 44, and hence of the legs support section 32, when lowered the variable distance D, are shown in phantom (FIG. 5) using the reference numerals 28', 32', 46'etc. Such variable lowering of the portions 40, 44, and hence of the legs support section 32, allows a user of the device 20 to squat comfortably while effectively supporting the weight of the body principally on the ischium support section 28.

Although the device 20 as illustrated in FIG. 5 includes a back and head support member 70 as in FIGS. 3 and 4, the device 20 without the back support member, is particularly useful as a bed attachment device (FIGS. 1 and 2). As such, attaching means 66, 67 (FIG.2) preferably are utilized, for example, at the foot of the base 102 (FIG. 5, not shown) to attach the back end of the ischium support section 28 to the end or side rail 64 of a bed as shown in FIG. 2. On the other hand, inclusion of the back and head support member 70 enables the device 20 to also be used effectively as a standalone piece of furniture device.

Although the present invention has been described in detail with particular reference to preferred embodiments thereof, it will be understood that variations and modifications can be effected within the spirit and scope of the invention.

What is claimed is:

1. A piece of furniture suitable for use generally and copulatively , the piece of furniture including:

(a) a seat member separated back-to-front into an ischium support section having a narrow sitting depth , and a legs support section comprised of separate right leg and left leg support portions, said right and left leg support portions being movable inwards and outwards between an apart position and a closed position;

(b) an access spacing defined adjacent said ischium support section by said right leg and left leg support portions in an apart position, said access spacing being at least as wide as the hip-width of a user of such piece of furniture; and (c) means for supporting said seat member at a plurality of predetermined heights for use generally and copulatively , said plurality of heights including a first predetermined copulative height that is equal to the distance between the top of the ischium support section and that of a reference surface, when the top of the ischium support section is substantially at the same level as the crotch region of a user kneeling on such reference surface adjacent to, and facing, said ischium support section.

2. The device of claim 1 including means for firmly attaching said seat member supporting means to an end or side rail of a bed usable by such arm amputee or other handicapped individual.

3. The device of claim 1 further including a back and head support member.

4. The device of claim 1 wherein the front edge of said ischium support section, adjoining said access spacing, includes a front-to-back cutout.

5. The device of claim 1 wherein the height of said legs support section can separately be lowered relative to the top of the ischium support section.

6. The device of claim 1 wherein said right leg and left leg support portions, each further includes a cutout in its outside edge at or near where it adjoins said ischium support section so that each leg support portion can pivot outwards as far as possible without any part thereof moving any further backwards of the back of said ischium support section.

7. The device of claim 1 further including comfortable means for kneeling on or standing on, located within said access spacing adjacent to, and below the top of said ischium support section.

8. The device of claim 1 wherein said plurality of heights includes a second predetermined copulative height that is equal to the distance between the top of the ischium support section, and that of a reference surface, when the top of the ischium support section is substantially at the same level as the crotch region of a user standing on such reference surface adjacent to, and facing, the ischium support section.

9. The device of claim 8 wherein said second predetermined copulative height is within the range of 76 to 92 centimeters (about 30 to 36 inches).

10. The device of claim 1 wherein said narrow sitting depth of said ischium support section is within the range of 13 to 25 centimeters (about 5 to 10 inches).

11. The device of claim 1 wherein said right leg and left leg support portions are movable pivotally up and down at, and with respect to, the top of the ischium support section.

12. The device of claim 1 wherein said right leg and left leg support portions each include a knee-type joint about which each can articulate along with the knee of a user of such device.

13. The device of claim 1 wherein said first predetermined copulative height is within the range of 33 to 43 centimeters (about 13 to 17 inches).

14. The device of claim 1 wherein said back and head support member includes lumbar support means.

15. A device suitable for supporting the weight of a person at a predetermined height for copulation, the device having a weight supporting surface divided back-to-front into an ischium support section having a narrow sitting depth of 13 to 25 centimeters (about five to ten inches) for accommodating and supporting only the ischium of a person sitting thereon, and a separate but adjoining legs support section, said legs support section further comprising separate right leg and left leg support portions movable inwards into a closed position and outwards into an apart position, said right leg and left leg support portions, when in said apart position, defining an access spacing adjacent, and in front of, said ischium support section, said access spacing being at least as wide as the hip-width of a user of said device.

* * * * *